United States Patent [19]

Haselswerdt et al.

[11] Patent Number: 4,918,764

[45] Date of Patent: Apr. 24, 1990

[54] ELECTRICALLY OPERATED TOILET

[75] Inventors: Vernon W. Haselswerdt, Willits; John M. Mayfield, Jr., Ukiah, both of Calif.

[73] Assignee: Microphor, Inc., Willits, Calif.

[21] Appl. No.: 206,251

[22] Filed: Jun. 13, 1988

[51] Int. Cl.[5] ..... E03D 5/10

[52] U.S. Cl. ..... 4/406; 4/DIG. 3; 4/435

[58] Field of Search ..... 4/366, 367, 378, 379, 4/405, 406, 413, DIG. 3, 434, 435, 431, 420; 137/624.11, 624.12; 200/574

[56] References Cited

U.S. PATENT DOCUMENTS 3,908,204 9/1975 Hopkins ..... 4/406

3,922,730 12/1975 Kemper ..... 4/318

4,144,903 3/1979 Gregory et al. ..... 137/624.11

4,783,859 11/1988 Rozenblatt et al. ..... 4/434

*Primary Examiner*—Ernest G. Cusick

*Assistant Examiner*—Glenn T. Barrett

*Attorney, Agent, or Firm*—Townsend and Townsend

[57] ABSTRACT

An electrically operated toilet wherein a toilet bowl is coupled to an electrically operated water valve which selectively flows water into the toilet bowl. An electrically operated waste valve is coupled to the discharge opening of the toilet bowl for selectively allowing waste material to pass out of the toilet bowl. A control unit is coupled to the water valve and to the waste valve for operating the water valve and the waste valve is a synchronous manner so that water is allowed to flow into the toilet and subsequently out of the discharge opening, while ensuring that the waste valve closes off the discharge opening after the flush cycle is completed.

12 Claims, 3 Drawing Sheets

ELECTRICALLY OPERATED TOILET

BACKGROUND OF THE INVENTION

1. Field Of The Invention

The present invention relates to toilet-flushing systems and, more particularly, to an electrically operated flushing apparatus.

2. Description Of The Related Art

Conventional toilets employ a water tank or reservoir coupled to a toilet bowl for flushing waste material from the toilet. The amount of water used in the flushing operation is determined by the amount of water stored in the water tank. Another feature of conventional toilets is a generally S-shaped conduit forming the discharge outlet. The shape of the conduit forms a water trap so that the path through the conduit is always blocked by water. This prevents odor and bacteria from the sewage system from entering the living environment.

Conventional toilets are unsuitable for marine or land recreational vehicle use because the vehicle typically cannot hold enough water to accommodate many flushings of a conventional toilet. Conventional toilets require a substantially large volume of water to complete the flushing operation, generally averaging about 4 to 6 gallons of water for each such flushing operation. Additionally, vibration and rocking motion of the vehicle or vessel causes the water in the tank or water trap to spill or leak out. Accordingly, toilets specially designed for marine and recreation vehicle use have been employed.

To minimize water consumption, some specially designed toilets use manually operated valves coupled to a pressurized water supply. In operation, the user depresses a lever or some other valve actuating mechanism, and water flows into the toilet bowl as long as the valve actuating mechanism is depressed. A major drawback to this type of toilet is that the user must keep pressure on the valve actuating mechanism for the entire duration of the flush cycle.

For eliminating conventional water traps, some toilets employ a plate pivotally connected to the discharge opening of the toilet bowl. The plate typically is spring-biased for covering the discharge opening, thereby sealing the environment from the holding tank or sewage system. In operation, the weight of the water or waste material ordinarily is sufficient pivot the plate, thereby allowing the waste material to flow out of the discharge opening. After the waste material passes out of the toilet bowl, the plate resumes its closed position. Unfortunately, the waste material frequently sticks to the plate and does not become dislodged when the plate pivots. Consequently, the discharge opening remains uncovered, thus subjecting the environment to odor and bacteria.

Finally, some toilets dispense with conventional waste processing procedures and use heating elements to incinerate the waste. The drawbacks of such toilets are that electrical heating elements require significant electrical currents to provide enough heat to incinerate the waste material, and combustion-type heating elements require storage tanks for a fuel supply. The former is not a feasible option for most, if not all, recreational vehicles, and the latter poses safety hazards.

SUMMARY OF THE INVENTION

The present invention is directed to an electrically operated toilet which eliminates the need for a conventional water tank, provides a complete flush cycle after a momentary stimulus by the user, ensures isolation of gases between the sewage system and the living environment, and does not require substantial current loads or combustible fuel supplies for operation.

In one embodiment of the invention, a toilet bowl is coupled to an electrically operated water valve which selectively flows water into the toilet bowl. An electrically operated waste valve is coupled to the discharge opening of the toilet bowl for selectively allowing waste material to pass out of the toilet bowl. A control unit is coupled to the water valve and to the waste valve for operating the water valve and the waste valve in a synchronous manner so that water is allowed to flow into the toilet and subsequently out of the discharge opening, while ensuring that the waste valve closes off the discharge opening after the flush cycle is completed.

These and other features and advantages of the invention will become apparent to those skilled in the art upon a reading of the following detailed description of the invention, which should be taken in conjunction with the accompanying drawings.

DESCRIPTION OF THE PREFERRED EMBODIMENTS

Figure 1:
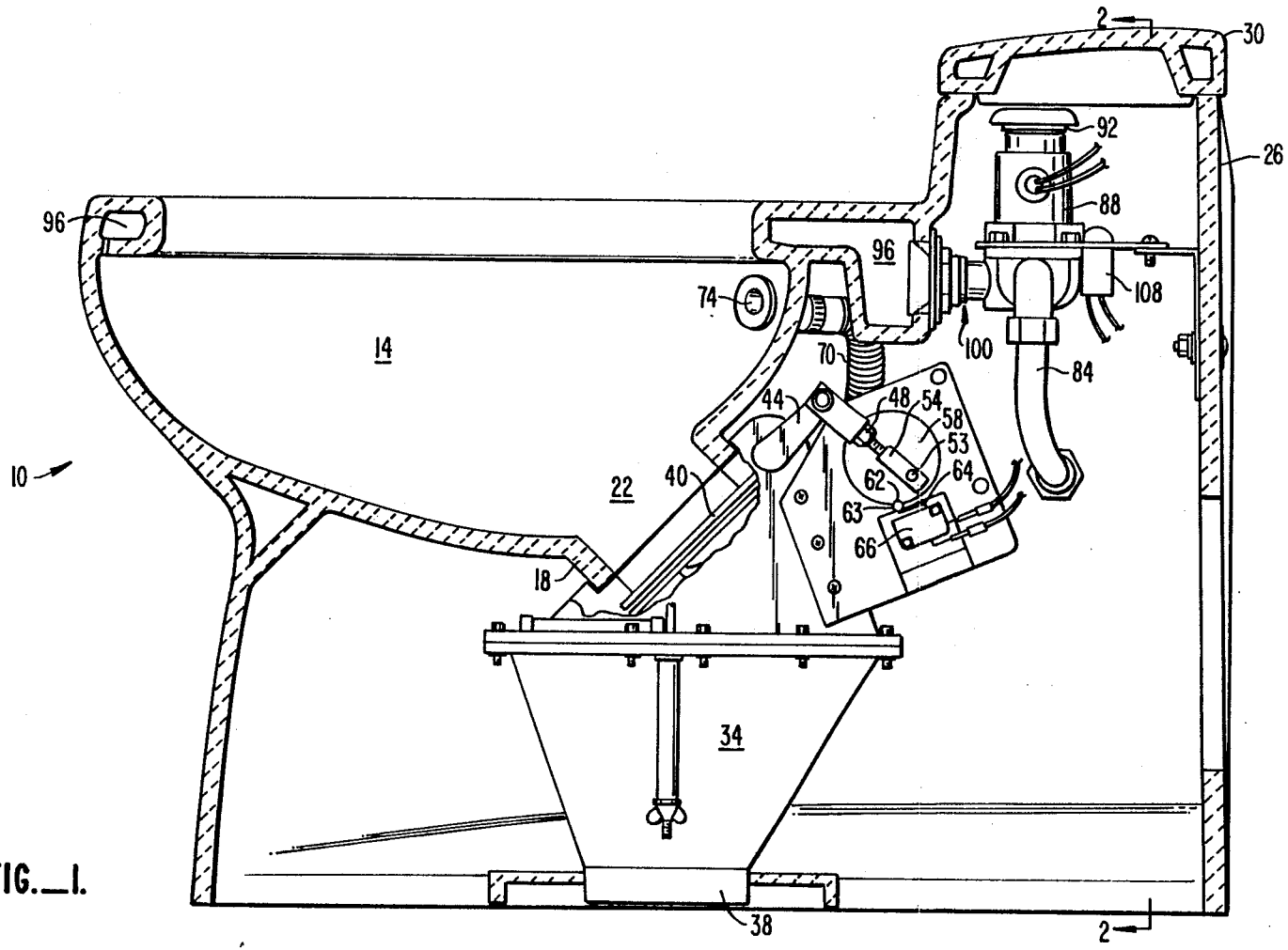
FIG. 1 is a side cross-sectional view of an electrically operated toilet according to the present invention.
Figure 2:
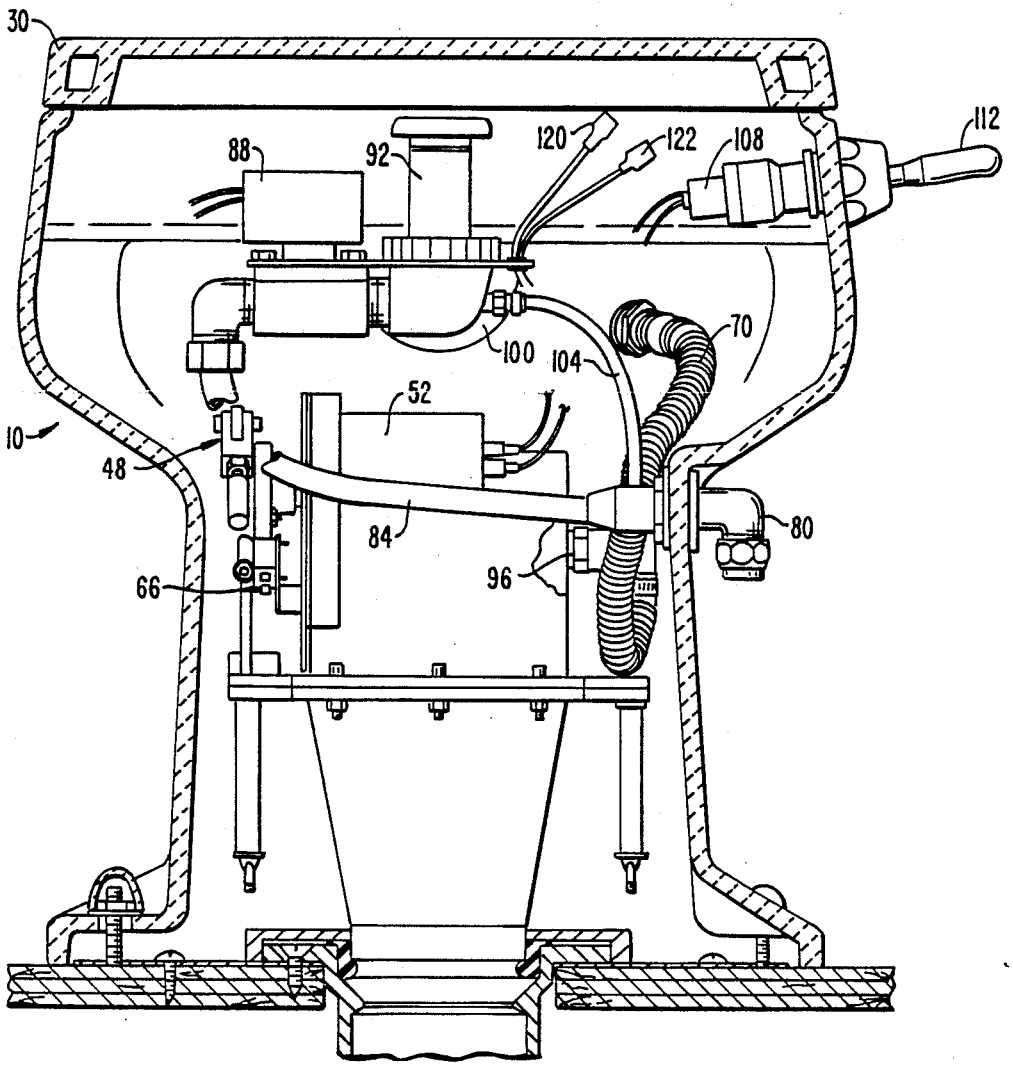
FIG. 2 is a rear cross-sectional view of a toilet according to the present invention taken along line 2—2 of FIG. 1.

FIGS. 1 and 2 illustrate an electrically operated toilet 10 according to the present invention. As more clearly seen in FIG. 1, toilet 10 includes a toilet bowl 14 having a generally tubular wall section 18 disposed at the bottom thereof for forming a discharge opening 22. Integrally formed with toilet bowl 14 is a flush component housing 26. Toilet above 14 and/or component housing 26 may be constructed of ceramic and/or stainless steel. Flush component housing 26 ordinarily contains the devices used to flush toilet 10. Flush component housing 26 includes an access cover 30 so that the components within flush component housing 26 may be accessed for removal or repair.

Disposed within flush component housing 26 is a hopper assembly 34 which is in fluid communication with discharge opening 22 of toilet bowl 14. Hopper assembly 34 receives waste material flowing through discharge opening 22 and communicates the waste material to a sewage system or holding tank (not shown) through a hopper outlet 38. Mounted within hopper assembly 34 is a flapper valve assembly comprising a plate 40 coupled at one end to a pivot arm 44. Plate 40 abuts against tubular wall section 18 of toilet bowl 14 for sealing the living environment against sewage gases and bacteria. Pivot arm 44 is further coupled to a linkage assembly 48 which, in turn, is coupled to a motor 52 (FIG. 2) through an offset shaft 53 and a cam 58. Cam 58 is coupled to motor 52 through a motor shaft 54. When in the state shown in FIG. 1, a cutout 62 of cam 58 engages a lobe 63 projecting from a lever 64 of a cycle limit switch 66. Switch 66 is off when cam 58 and lobe 63 are in this position.

An overflow hose 70 is fluidly coupled between an opening 74 in the upper portion of toilet bowl 14 and an opening 96 (FIG. 2) in hopper assembly 34. Should discharge opening 22 become clogged, overflow hose 70 ensures that water will not flow over the top of toilet bowl 14 and into the living environment.

As more clearly seen in FIG. 2, toilet 10 includes a water inlet 80 which is in fluid communication with a water supply tube 84. Water inlet 80 receives water from a pressurized source (not shown). Water supply tube 84, in turn, is coupled to an electrically operated solenoid valve 88 and a vacuum breaker assembly 92. Water flowing past solenoid valve 88 is communicated to a water distribution chamber 96 (FIG. 1). which encircles the upper portion of toilet bowl 14, through a water outlet assembly 100. If desired, water may be communicated from outlet 100 to overflow hose 70 through a tube 104 to replenish a water trap formed by the lower portion of overflow hose 70 during each flush cycle. Finally, a momentary flush switch 108 is coupled to a flush handle 112 for operation by the user.

Figure 3:
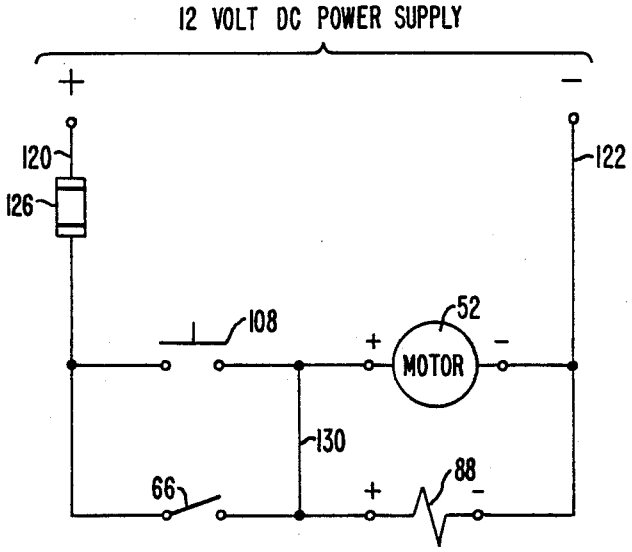
FIG. 3 is a schematic of a control circuit used in a toilet according to the present invention.

The wiring harness used to interconnect the components within flush component housing 26 is not shown for clarity. However, the electrical connection of the components may be understood by referring to FIG. 3. As shown in FIG. 3, current is supplied to the components through positive and negative leads 120 and 122, respectively. Positive lead 120 is coupled to the input terminals of cycle limit switch 66 and flush switch 112 through a fuse 126. The output terminals of cycle limit switch 66 and flush switch 112 are connected together so that current is supplied to motor 52 and solenoid valve 88 when either cycle limit switch 66 or flush switch 108 is closed. The output terminals of cycle limit switch 66 and flush switch 108 are connected to the positive terminals of motor 52 and solenoid valve 88. The negative terminals of motor 52 and solenoid valve 88 are coupled to negative lead 122.

In operation, flush handle 112 is momentarily depressed and released. When flush handle 112 is depressed, flush switch 108 causes current to flow into solenoid valve 88 and motor 52, and water begins to flow past solenoid valve 88, through outlet 100, and into distribution chamber 96. Once motor shaft 54 starts turning, cutout 62 on cam 58 moves away from lobe 64, and the outer periphery of cam 58 depresses lever 64 to close switch 66 for maintaining current flow to motor 52 and solenoid valve 88 after flush handle 112 is released. At the same time, linkage assembly 48 rotates for causing pivot arm 44 to pivot and cause plate 40 to uncover discharge opening 22. This allows water and waste material to flow into hopper assembly 34. The cycle continues until cam 58 makes a complete revolution, whereupon lobe 63 again engages cutout 62 in cam 58. This opens cycle limit switch 66, cutting off current to motor 52 and solenoid valve 88. Solenoid valve 88 shuts off the water supply to distribution chamber 96, and plate 40 resumes it closed position for completing the flush cycle.

While the above is a complete description of a preferred embodiment of the present invention, various modifications may be employed. For example, cycle limit switch 66 may turn off when switch lever 64 is depressed, with cam 58 configured accordingly. The flush mechanism, i.e., water solenoid valve 88, vacuum breaker assembly 92, flush switch 108 and flush handle 112 may be placed in a remote location from flush component housing 26. All functions can be performed by suitably programmed separate electrical timers connected to the operating components for eliminating the mechanical cam and linkage assembly shown. Consequently, the scope of the invention should not be limited except as properly described in the claims.

I claim:

1. An electrically operated toilet comprising:

water receiving means for receiving pressurized water;

a toilet bowl in fluid communication with the water receiving means, the toilet bowl having a discharge opening for flowing waste material therefrom;

an electrically operated water valve, coupled to the water receiving means, for selectively allowing water to flow into the toilet bowl;

an electrically operated waste valve, coupled to the toilet bowl, for selectively allowing waste material to flow through the discharge opening, the waste valve including a cover for covering the discharge opening; and control means, coupled to the water valve and to the waste valve, for operating the water valve and the waste valve so that water is allowed to flow into the toilet and subsequently out of the discharge opening, the control means comprising:

a first switch for selectively activating the water valve;

a motor;

linkage means, coupled to the motor and to the cover, for moving the cover for selectively uncovering the discharge opening when the motor is activated;

switch activating means, disposed in close proximity to the first switch, for causing the first switch to activate the water valve when the motor is activated, the switch activating means including a cam mounted on the motor, the cam rotating when the motor is activated, and the cam having a lobe which selectively contacts the first switch.

2. The toilet according to claim 1 wherein the control means further comprises a manually operated second switch connected for activating the motor.

3. The toilet according to claim 2 wherein the first switch deactivates the water valve when the cam is in a prescribed position.

4. The toilet according to claim 3 wherein the cam moves away from the prescribed position when the second switch is operated.

5. The toilet according to claim 4 wherein the first switch is coupled to the motor for supplying current to the motor and thereby maintaining the motor activated when the cam is not in the prescribed position.

6. The toilet according to claim 5 wherein the cam returns to the prescribed position at the end of a flush cycle.

7. The toilet according to claim 6 wherein the cam rotates 360 degrees during each flush cycle.

8. The toilet according to claim 7 wherein the second switch is connected for activating the water valve.

9. The toilet according to claim 8 wherein the toilet bowl has an overflow opening disposed in an upper portion thereof.

10. The toilet according to claim 9 further comprising a conduit in fluid communication with the overflow opening for receiving material flowing therethrough.

11. The toilet according to claim 10 wherein the conduit is shaped for forming a water trap.

12. The toilet according to claim 8 wherein the second switch comprises a momentary switch for initiating the operation of the water valve and the waste valve.

* * * * *